US007897314B1

(12) United States Patent
Wu et al.

(10) Patent No.: US 7,897,314 B1
(45) Date of Patent: Mar. 1, 2011

(54) POSS MELAMINE OVERCOATED PHOTOCONDUCTORS

(75) Inventors: Jin Wu, Pittsford, NY (US); Kenny-Tuan T Dinh, Webster, NY (US); Jennifer A Coggan, Kitchener (CA); Marc J Livecchi, Rochester, NY (US); Edward C Savage, Webster, NY (US); Michael E Zak, Canandaigua, NY (US)

(73) Assignee: Xerox Corporation, Norwalk, CT (US)

( * ) Notice: Subject to any disclaimer, the term of this patent is extended or adjusted under 35 U.S.C. 154(b) by 47 days.

(21) Appl. No.: 12/550,502

(22) Filed: Aug. 31, 2009

(51) Int. Cl.
*G03G 15/04* (2006.01)

(52) U.S. Cl. ..... 430/66; 430/58; 430/59.4; 430/123.42

(58) Field of Classification Search ..... 430/58, 430/59.4, 66, 123.42
See application file for complete search history.

(56) References Cited

U.S. PATENT DOCUMENTS

| | | | | |
|---|---|---|---|---|
| 4,921,769 | A | 5/1990 | Yuh et al. | |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 6,913,863 | B2 | 7/2005 | Wu et al. | |
| 7,037,631 | B2 | 5/2006 | Wu et al. | |
| 7,799,494 | B2 * | 9/2010 | Wu et al. | 430/58.8 |
| 2008/0107978 | A1 * | 5/2008 | Yanus et al. | 430/48 |
| 2008/0107979 | A1 | 5/2008 | Yanus et al. | |
| 2008/0107985 | A1 | 5/2008 | Yanus et al. | |
| 2009/0162766 | A1 | 6/2009 | Wu et al. | |

OTHER PUBLICATIONS

Jin Wu, U.S. Appl. No. 12/033,276 on Overcoated Photoconductors, filed Feb. 19, 2008.

* cited by examiner

*Primary Examiner*—Thorl Chea
(74) *Attorney, Agent, or Firm*—Oliff & Berridge, PLC

(57) ABSTRACT

A photoconductor containing an optional supporting substrate, a photogenerating layer, a charge transport layer or layers, and an overcoating layer containing a crosslinked mixture of a POSS component, a melamine polymer, and a charge transport like a hole transport compound.

34 Claims, No Drawings

POSS MELAMINE OVERCOATED PHOTOCONDUCTORS

CROSS REFERENCE TO RELATED APPLICATIONS

U.S. application Ser. No. 12/033,276, filed Feb. 19, 2008, entitled Overcoated Photoconductors, the disclosure of which is totally incorporated herein by reference, discloses a photoconductor comprising an optional supporting substrate, a photogenerating layer, and at least one charge transport layer, and wherein at least one charge transport layer contains at least one charge transport component; and an overcoating layer in contact with and contiguous to the charge transport layer, and which overcoating is comprised of a self crosslinked acrylic resin, a charge transport component, and a low surface energy additive.

U.S. application Ser. No. 11/593,875, U.S. Publication No. 20080107985, filed Nov. 7, 2006 on Silanol Containing Overcoated Photoconductors, the disclosure of which is totally incorporated herein by reference, which discloses an imaging member comprising an optional supporting substrate, a silanol containing photogenerating layer, and at least one charge transport layer comprised of at least one charge transport component and an overcoating layer in contact with and contiguous to the charge transport, and which overcoating is comprised of an acrylated polyol, a polyalkylene glycol, a crosslinking agent, and a charge transport component.

U.S. application Ser. No. 11/593,656, U.S. Publication No. 20080107979, filed Nov. 7, 2006 on Silanol Containing Charge Transport Overcoated Photoconductors, the disclosure of which is totally incorporated herein by reference, which discloses an imaging member comprising an optional supporting substrate, a photogenerating layer, and at least one charge transport layer comprised of at least one charge transport component and at least one silanol; and an overcoating in contact with and contiguous to the charge transport layer, and which overcoating is comprised of an acrylated polyol, a polyalkylene glycol, a crosslinking component, and a charge transport component.

U.S. application Ser. No. 11/961,549, U.S. Publication No. 20090162766, filed Dec. 20, 2007 on Photoconductors Containing Ketal Overcoats, the disclosure of which is totally incorporated herein by reference, discloses a photoconductor comprising a supporting substrate, a photogenerating layer, and at least one charge transport layer comprised of at least one charge transport component, and an overcoat layer in contact with and contiguous to the charge transport layer, and which overcoat is comprised of a crosslinked polymeric network, an overcoat charge transport component, and at least one ketal.

A number of the components and amounts thereof of the above copending applications, such as the supporting substrates, resin binders, photogenerating layer components, antioxidants, charge transport components, hole blocking layer components, adhesive layers, and the like, may be selected for the photoconductive members of the present disclosure in embodiments thereof.

BACKGROUND

This disclosure is generally directed to layered imaging members, photoreceptors, photoconductors, and the like. More specifically, the present disclosure is directed to multilayered flexible, belt imaging members, or devices comprised of an optional supporting medium like a know substrate, a photogenerating layer, a charge transport layer, including a plurality of charge transport layers, such as a first charge transport layer and a second charge transport layer, an optional adhesive layer, an optional hole blocking or undercoat layer, and an overcoating layer comprised, for example, of a crosslinked charge transport component, a melamine resin or polymer, and a crosslinkable polyhedral oligomeric silsesquioxane (POSS), such as a POSS alcohol, a POSS epoxide, a POSS amine, or a POSS carboxylic acid, and the like, and where the overcoat layer can further contain, in embodiments, an acid catalyst and a crosslinkable low surface energy component like a siloxane and a fluoro component.

The photoconductors illustrated herein, in embodiments, have excellent wear resistance, extended lifetimes of about 1,000,000 xerographic imaging cycles, exhibit, in embodiments, a $V_r$ of about 150V, excellent A zone and J zone cyclic stability, excellent LCM resistance, and a biased charging roll (BCR) wear rate of about 6.6 nanometers/kilocycle; elimination or minimization of imaging member scratches on the surface layer or layers of the member, and which scratches can result in undesirable print failures where, for example, the scratches are visible on the final prints generated. Additionally, in embodiments the imaging members disclosed herein possess excellent, and in a number of instances, low $V_r$ (residual potential), and allow the substantial prevention of $V_r$ cycle up when appropriate; high sensitivity; low acceptable image ghosting characteristics; low background and/or minimal charge deficient spots (CDS); and desirable toner cleanability.

Also included within the scope of the present disclosure are methods of imaging and printing with the photoresponsive or photoconductive devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in high resolution color xerographic applications, particularly high speed color copying and printing processes.

REFERENCES

There is illustrated in U.S. Pat. No. 7,037,631 a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,913,863 a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members are known, and illustrated in a number of patents such as U.S. Pat. No. 4,265,990.

Further, in U.S. Pat. No. 4,555,463 there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene pigment photogenerating component.

In U.S. Pat. No. 4,921,769, the disclosure of which is totally incorporated herein by reference, there are illustrated photoconductive imaging members with blocking layers of certain polyurethanes.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and more specifically, about 19 parts with 1,3-diiminoisoindolene ($DI^3$) in an amount of from about 1 part to about 10 parts, and more specifically, about 4 parts of $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and more specifically, about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and more specifically, about 24 hours.

SUMMARY

Disclosed are imaging members with many of the advantages illustrated herein, such as extended lifetimes of service of, for example, in excess of about 1,000,000 imaging cycles; excellent electronic characteristics; stable electrical properties; low image ghosting; low background and/or minimal charge deficient spots (CDS); resistance to charge transport layer cracking upon exposure to the vapor of certain solvents; excellent surface characteristics; improved wear resistance; compatibility with a number of toner compositions; the avoidance of or minimal imaging member scratching characteristics; consistent $V_r$ (residual potential) that is substantially flat or no change over a number of imaging cycles as illustrated by the generation of known PIDCs (Photo-Induced Discharge Curve); minimum cycle up in residual potential; acceptable background voltage that is, for example, a minimum background voltage of about 2.6 milliseconds after exposure of the photoconductor to a light source; rapid PIDCs together with low residual voltages, and the like.

Moreover, disclosed are layered belt photoresponsive or photoconductive imaging members with mechanically robust and solvent resistant charge transport surface layers.

Additionally disclosed are rigid imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000 permitting, for example, a hole blocking layer with excellent efficient electron transport which usually results in a desirable photoconductor low residual potential $V_{low}$.

Also disclosed are layered flexible belt photoreceptors containing a wear resistant, and anti-scratch charge transport layer or layers, and where the hardness of the member is increased by the addition of suitable crosslinked containing mixtures as illustrated herein; and wherein there is permitted the prevention of $V_r$ cycle up, caused primarily by photoconductor aging, for numerous imaging cycles, and where the imaging members exhibit low background and/or minimal CDS; and the prevention of $V_r$ cycle up, caused primarily by photoconductor aging, for numerous imaging cycles.

EMBODIMENTS

Aspects of the present disclosure relate to a photoconductor comprised in sequence of a supporting substrate, a photogenerating layer comprised of at least one photogenerating pigment, thereover a charge transport layer comprised of at least one charge transport component, and a layer in contact with and contiguous to the charge transport layer, and which layer is an overcoating layer comprised, for example, of a crosslinked charge transport component, a melamine resin or polymer and a crosslinkable POSS, such as a POSS alcohol, a POSS epoxide, a POSS amine, or a POSS carboxylic acid, and the like, and where the overcoat layer can further contain, in embodiments, an acid catalyst and a crosslinkable low surface energy component like a siloxane and a fluoro component; a photoconductor comprising an optional supporting substrate, a photogenerating layer, and a charge transport layer comprised of at least one charge transport component, and an overcoating in contact with and contiguous to the charge transport layer, and which overcoating is comprised of a crosslinked mixture of a charge transport component, a melamine polymer, and at least one of a polyhedral oligomeric silsesquioxane (POSS) alcohol, and a polyhedral oligomeric silsesquioxane (POSS) epoxide; a photoconductor comprised in sequence of a supporting substrate, a photogenerating layer comprised of at least one photogenerating pigment, thereover a charge transport layer comprised of at least one charge transport component and an overcoating layer in contact with the surface of the charge transport layer, and which overcoating layer is comprised of a mixture of an overcoating charge transport component, a melamine polymer and POSS component of at least one of a POSS alcohol, a POSS epoxide, a POSS amine, and a POSS carboxylic acid, and wherein the mixture is crosslinked in the presence of a catalyst; and wherein the charge transport component for the charge transport layer is represented by

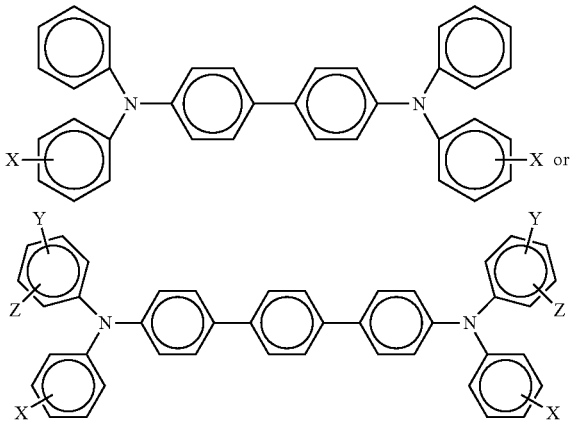

wherein each x, y and z are alkyl, alkoxy, halogen or aryl, and said charge transport component for said overcoating layer is represented by

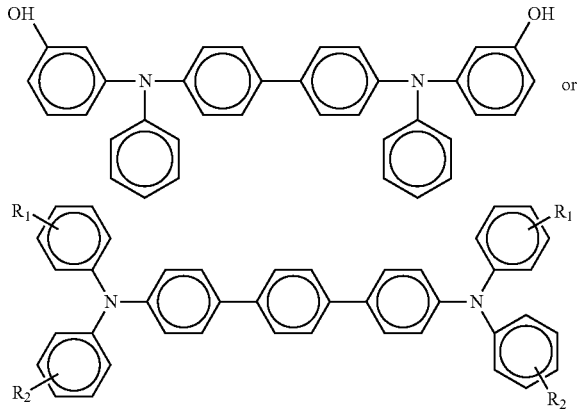

wherein each $R_1$ and $R_2$ is independently selected from the group consisting of at least one of —H, —OH, —$C_nH_{2n+1}$ where n is from 1 to about 12, aralkyl or aryl, and wherein the melamine polymer is represented by

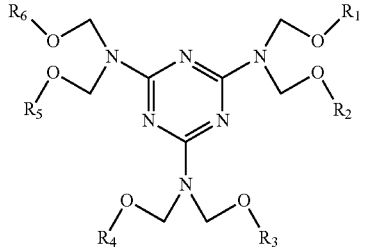

wherein $R_1$, $R_2$, $R_3$, $R_4$, $R_5$ and $R_6$ independently represent a hydrogen atom, alkyl, aryl, or mixtures thereof, and the overcoating layer further contains a catalyst, a crosslinkable siloxane and a fluoro component; and wherein the POSS component is represented by

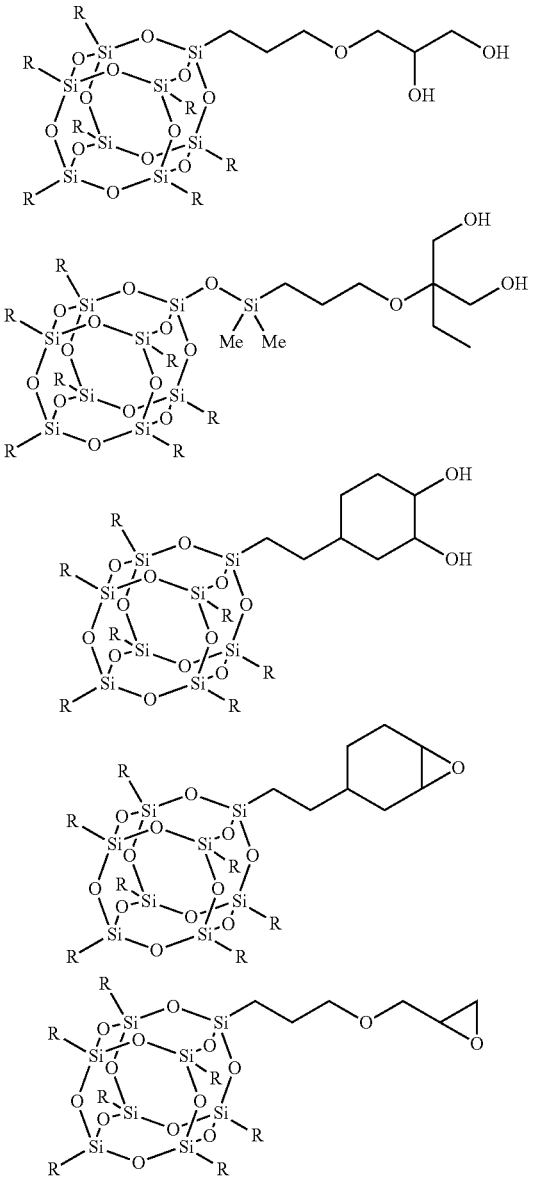

-continued

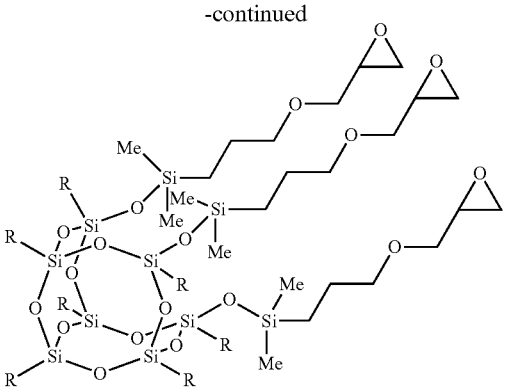

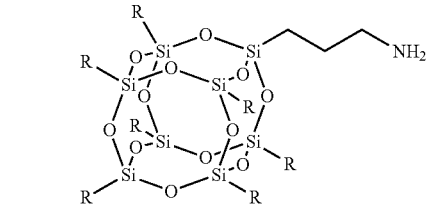

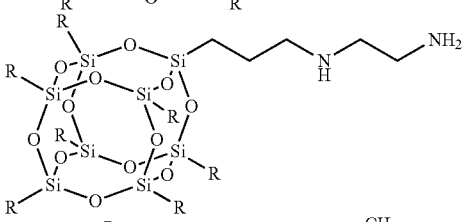

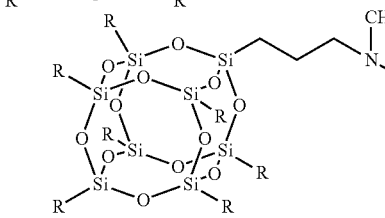

or

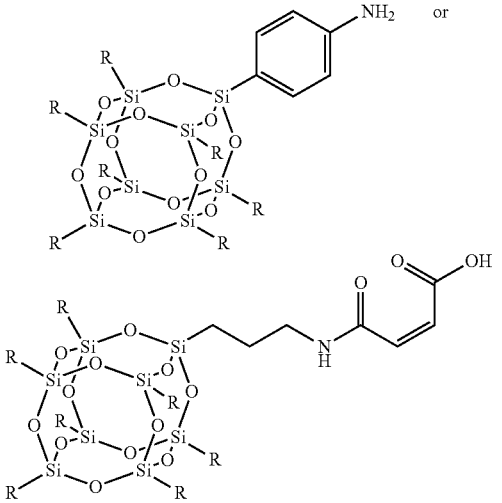

wherein each R substituent is alkyl or aryl; and a photoconductor comprised in sequence of a supporting substrate, a photogenerating layer comprised of at least one photogenerating pigment, thereover at least one, such as from 1 to about 4, charge transport layer or layers comprised of at least one charge transport component and an overcoating layer in contact with the surface of the charge transport layer, and which overcoating layer is comprised of a crosslinked mixture of an overcoating charge transport component, a melamine polymer, and a POSS alcohol, a POSS epoxide, a POSS amine or a POSS carboxylic acid, and wherein the mixture is crosslinked in the presence of a catalyst, and wherein the melamine polymer is present in an amount of from about 1 to about 70 weight percent; the overcoating charge transport component is present in an amount of from about 20 to about 90 weight percent, and the POSS component is present in an amount of from about 1 to about 30 weight percent of the overcoating layer.

Examples of Overcoating Components

The overcoating for the photoconductors disclosed herein is, in embodiments, comprised of a mixture of a charge transport component, a melamine resin or polymer, and a crosslinkable POSS, such as a POSS alcohol, a POSS epoxide, a POSS amine, or a POSS carboxylic acid, and the like, and where the overcoat layer can further optionally contain, in embodiments, an acid catalyst and a crosslinkable low surface energy component like a siloxane, a fluoro containing component, or mixtures thereof.

In embodiments, the POSS alcohol molecule comprises one POSS moiety, and at least one alcohol group, where at least one is from about 1 to about 8, from about 1 to about 4, from 1 to 4, and from 1 to 2. Typical POSS alcohols can be represented by

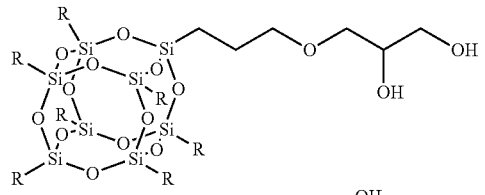

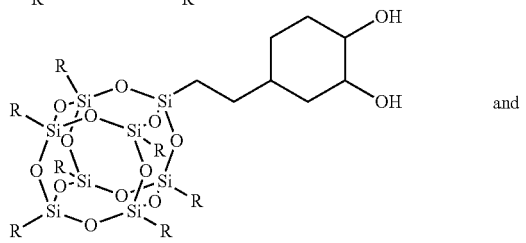

and

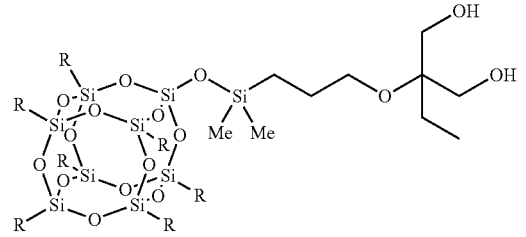

wherein R is a suitable hydrocarbon such as alkyl and aryl, and Me is methyl. Examples of alkyl contain from about 1 to about 18 carbon atoms, from about 2 to about 12 carbon atoms, and from 4 to about 6 carbon atoms, such as methyl, ethyl, propyl, butyl, isobutyl, pentyl, hexyl, cyclohexyl, and the like, and various isomers thereof. Aryl examples contain, for example, from about 6 to about 24 carbon atoms, from about 6 to about 18 carbon atoms, and from about 6 to about 12 carbon atoms, such as phenyl, and the like.

Specific POSS alcohol examples include TMP diolisobutyl POSS, trans-cyclohexanediolisobutyl POSS, 1,2-propanediolisobutyl POSS, octa(3-hydroxy-3-methylbutyldimethylsiloxy) POSS, all available from Hybrid Plastics Inc., Hattiesburg, Miss.

Examples of POSS epoxides comprises one POSS moiety and at least one epoxide group, where at least one is from about 1 to about 8, from 1 to about 4, from 1 to 4, from 1 to 3, and from 1 to 2. Typical POSS epoxides can be represented by

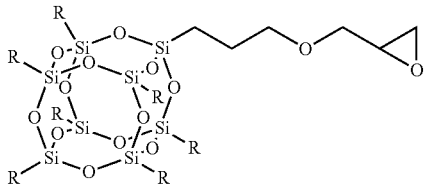

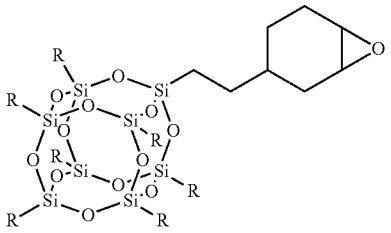

and

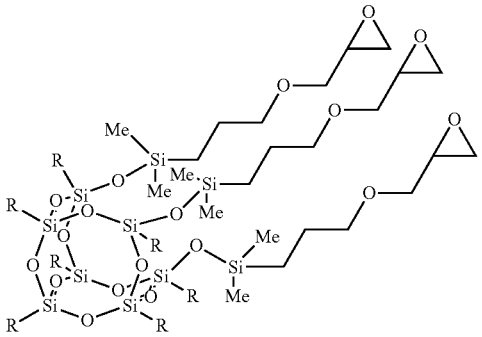

wherein R is a suitable hydrocarbon such as alkyl and aryl. Examples of alkyl contain from about 1 to about 18 carbon atoms, from 2 to about 12 carbon atoms, and from 4 to about 6 carbon atoms, such as methyl, ethyl, propyl, butyl, isobutyl, pentyl, hexyl, cyclohexyl, and the like, and various isomers thereof. Aryl examples contain, for example, from about 6 to about 24 carbon atoms, from about 6 to about 18 carbon atoms, from about 6 to about 12 carbon atoms, such as phenyl, and the like.

Specific POSS epoxide examples include epoxycyclohexylisobutyl POSS, glycidylethyl POSS, glycidylisobutyl POSS, glycidylisooctyl POSS, triglycidylcyclohexyl POSS, triglycidylisobutyl POSS, glycidylphenyl POSS, octaepoxycyclohexyldimethylsilyl POSS, octaglycidyldimethylsilyl POSS, all available from Hybrid Plastics Inc., Hattiesburg, Miss.

Examples of POSS carboxylic acid molecule comprises one POSS moiety, and at least one carboxylic acid group, where at least one is from about 1 to about 8. Typical POSS carboxylic acids can be represented by

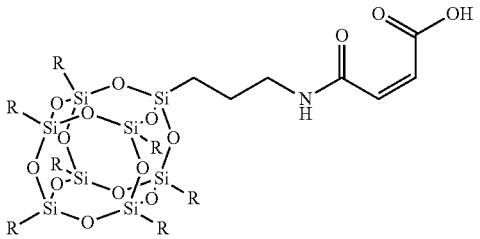

wherein R is a suitable hydrocarbon such as alkyl and aryl. Examples of alkyl contain from about 1 to about 18 carbon atoms, from 2 to about 12 carbon atoms, from 4 to about 6 carbon atoms, such as methyl, ethyl, propyl, butyl, isobutyl, pentyl, hexyl, cyclohexyl, and the like, and various isomers thereof. Aryl examples contain, for example, from about 6 to about 24 carbon atoms, from about 6 to about 18 carbon atoms, or from about 6 to about 12 carbon atoms, such as phenyl, and the like.

Specific POSS carboxylic acid examples include amic acid-cyclohexyl POSS, amic acid-isobutyl POSS, amic acid-phenyl POSS, octa amic acid POSS, all available from Hybrid Plastics Inc., Hattiesburg, Miss.

In embodiments, the POSS amine molecule comprises one POSS moiety and at least one amine group, where at least one is from about 1 to about 8, from 1 to about 4, from 1 to 2. Typical POSS amines can be represented by

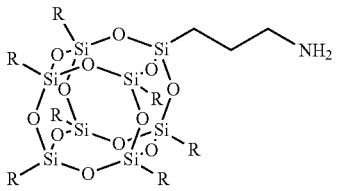

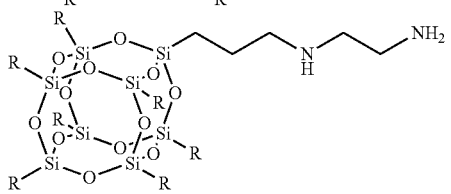

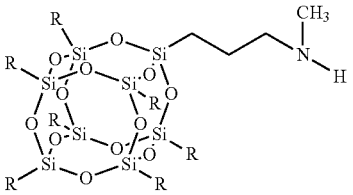

and

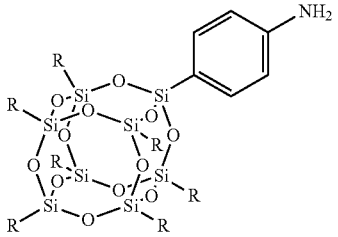

wherein R is a suitable hydrocarbon such as alkyl and aryl. Examples of alkyl contain from about 1 to about 18 carbon atoms, from 2 to about 12 carbon atoms, from 4 to about 6 carbon atoms, such as methyl, ethyl, propyl, butyl, isobutyl, pentyl, hexyl, cyclohexyl, and the like, and various isomers thereof. Aryl examples contain, for example, from about 6 to about 24 carbon atoms, from about 6 to about 18 carbon atoms, from about 6 to about 12 carbon atoms, such as phenyl, and the like.

Specific POSS amine examples include aminopropylisobutyl POSS, aminopropyl isooctyl POSS, aminopropylphenyl POSS, aminoethylaminopropylisobutyl POSS, octaminophenyl POSS, N-phenylaminopropyl POSS, N-methylaminopropylisobutyl POSS, octaammonium POSS, p-aminophenylcyclohexyl POSS, m-aminophenylcyclohexyl POSS, p-aminophenylisobutyl POSS, m-aminophenylisobutyl POSS, all available from Hybrid Plastics Inc., Hattiesburg, Miss.

In embodiments, the overcoat layer is in contact with and contiguous to the top charge transport layer, and which overcoating layer is formed from a mixture of a crosslinked mixture of a charge transport component, a melamine resin or polymer and a crosslinkable POSS, such as a POSS alcohol, a POSS epoxide, a POSS amine, or a POSS carboxylic acid, and the like, and where the overcoat layer can further optionally contain, in embodiments, an acid catalyst and a crosslinkable low surface energy component like a siloxane and a fluoro component, and resulting in the presence of the catalyst in a polymeric crosslinked network.

Examples of melamine polymers selected for the overcoat layer are, for example, represented by

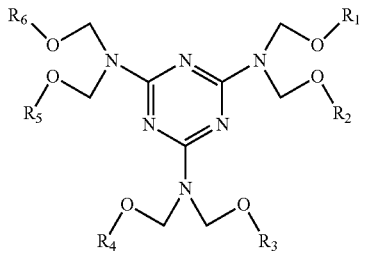

wherein $R_1$, $R_2$, $R_3$, $R_4$, $R_5$ and $R_6$ independently represent a hydrogen atom, an alkyl or substituted alkyl group or groups with, for example, from about 1 to about 24 carbon atoms, from 1 to about 12 carbon atoms, from 1 to about 8 carbon atoms, and from 1 to about 4 carbon atoms.

Specific examples of melamine polymers incorporated into the overcoat layer are, for example, highly alkylated/alkoxylated, partially alkylated/alkoxylated, or mixed al kylated/alkoxylated; methylated, n-butylated or isobutylated; highly methylated melamine resins such as CYMEL® 303, 350, 9370; methylated high imino melamine resins, partially methylolated and highly alkylated) such as CYMEL® 323, 327; partially methylated melamine resins (highly methylolated and partially methylated) such as CYMEL® 373, 370; high solids mixed ether melamine resins such as CYMEL® 1130, 324; n-butylated melamine resins such as CYMEL® 1151, 615; n-butylated high imino melamine resins such as CYMEL® 1158; and iso-butylated melamine resins such as CYMEL® 255-10. CYMEL® melamine resins are commercially available from CYTEC Industries, Inc., and yet more specifically, the melamine resin may be selected from the group consisting of methylated formaldehyde-melamine resin, methoxymethylated melamine resin, ethoxymethylated melamine resin, propoxymethylated melamine resin, butoxymethylated melamine resin, hexamethylol melamine resin, alkoxyalkylated melamine resins such as methoxymethylated melamine resin, ethoxymethylated melamine resin, propoxymethylated melamine resin, butoxymethylated melamine resin, and mixtures thereof.

The overcoating layer also includes a charge transport component represented, for example, by

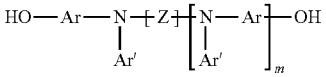

wherein m is zero or 1; Z is selected from the group consisting of at least one of

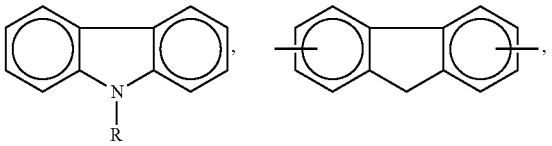

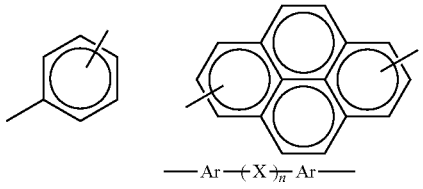

and wherein n is 0 or 1: Ar is selected from the group consisting of at least one of

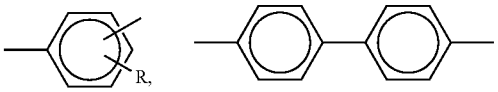

and

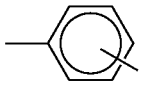

wherein R is selected from the group consisting of at least one of —$CH_3$, —$C_2H_5$, —$C_3H_7$, and $C_4H_9$; Ar' is selected from the group consisting of at least one of

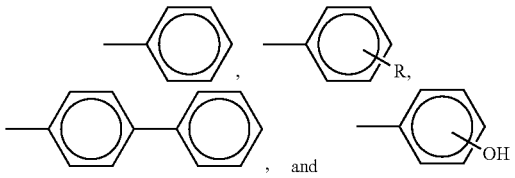

and X is selected from the group consisting of at least one of

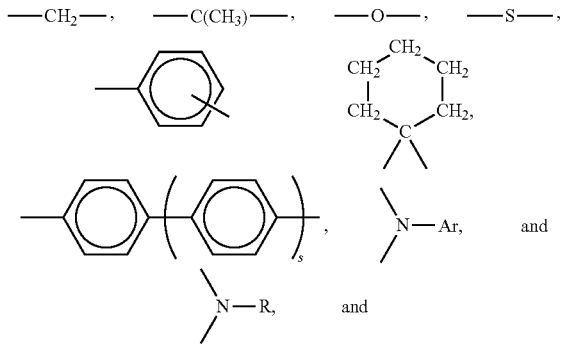

wherein S is zero, 1, or 2.

Examples of charge transport components for the overcoat include alcohol soluble charge transport materials such as N,N'-diphenyl-N,N'-bis(3-hydroxyphenyl)-[1,1'-biphenyl]-4,4'-diamine (DHTPD) represented by

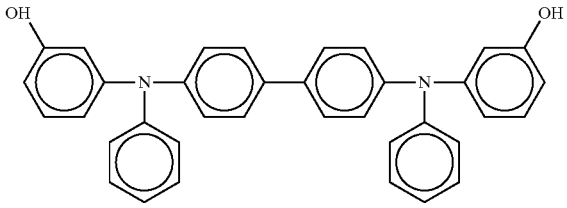

or dihydroxyaryl terphenylamines as represented by

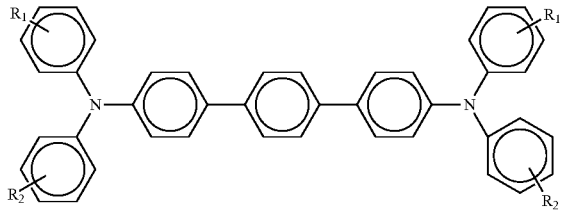

wherein each $R_1$ and $R_2$ is independently selected from the group consisting of at least one of —H, —OH, $—C_nH_{2n+1}$ where n is from 1 to about 12; aralkyl, and aryl containing, for example, from about 6 to about 36 carbon atoms.

In embodiments, the overcoating charge transport component is present in an amount of from about 20 to about 90 weight percent, or from about 30 to about 60 weight percent of the overcoating layer components; the melamine resin is present in an amount of from about 1 to about 70 weight percent, or from about 10 to about 50 weight percent of the overcoating layer components; and the POSS component is present in an amount of from about 1 to about 30 weight percent, or from about 5 to about 15 weight percent, and the total thereof is 100 percent. These three components of the overcoating layer may be crosslinked together to form a polymeric network.

The overcoating layer further comprises an optional siloxane component, or an optional fluoro component present, for example, in an amount of from about 0.1 to about 10 weight percent, or from about 0.5 to about 5 weight percent of the layer.

Examples of the siloxane component, which in embodiments is crosslinked, present in the overcoating layer include hydroxyl derivatives of silicone modified polyacrylates such as BYK-SILCLEAN® 3700; polyether modified acryl polydimethylsiloxanes such as BYK-SILCLEAN® 3710; and polyether modified hydroxyl polydimethylsiloxanes such as BYK-SILCLEAN® 3720. BYK-SILCLEAN® is a trademark of BYK.

Examples of the crosslinkable fluoro component, which in embodiments is crosslinked, present in the overcoating layer include (1) hydroxyl derivatives of perfluoropolyoxyalkanes such as FLUOROLINK® D (M.W. of about 1,000 and a fluorine content of about 62 percent), FLUOROLINK® D10-H (M.W. of about 700 and fluorine content of about 61 percent), and FLUOROLINK® D10 (M.W. of about 500 and fluorine content of about 60 percent) (functional group $—CH_2OH$); FLUOROLINK® E (M.W. of about 1,000 and a fluorine content of about 58 percent), and FLUOROLINK® E10 (M.W. of about 500 and fluorine content of about 56 percent) (functional group $—CH_2(OCH_2CH_2)_nOH$); FLUOROLINK® T (M.W. of about 550 and fluorine content of about 58 percent), and FLUOROLINK® T10 (M.W. of about 330 and fluorine content of about 55 percent) (functional group $—CH_2OCH_2CH(OH)CH_2OH$); (2) hydroxyl derivatives of perfluoroalkanes ($R_fCH_2CH_2OH$, wherein $R_f$=F $(CF_2CF_2)_n$) wherein n represents the number of groups, such as about 1 to about 50, such as ZONYL® BA (M.W. of about 460 and fluorine content of about 71 percent), ZONYL® BA-L (M.W. of about 440 and fluorine content of about 70 percent), ZONYL® BA-LD (M.W. of about 420 and fluorine content of about 70 percent), and ZONYL® BA-N (M.W. of about 530 and fluorine content of about 71 percent); (3) carboxylic acid derivatives of fluoropolyethers such as FLUOROLINK® C (M.W. of about 1,000 and fluorine content of about 61 percent); (4) carboxylic ester derivatives of fluoropolyethers such as FLUOROLINK® L (M.W. of about 1,000 and fluorine content of about 60 percent), FLUOROLINK® L10 (M.W. of about 500 and fluorine content of about 58 percent); (5) carboxylic ester derivatives of perfluoroalkanes ($R_fCH_2CH_2O(C{=}O)R$, wherein $R_f$=$F(CF_2CF_2)_n$, and n is as illustrated herein, and R is alkyl) such as ZONYL® TA-N (fluoroalkyl acrylate, R=$CH_2$=CH—, M.W. of about 570 and fluorine content of about 64 percent), ZONYL® TM (fluoroalkyl methacrylate, R=$CH_2$=$C(CH_3)$—, M.W. of about 530 and fluorine content of about 60 percent), ZONYL® FTS (fluoroalkyl stearate, R=$C_{17}H_{35}$—, M.W. of about 700 and fluorine content of about 47 percent), ZONYL® TBC (fluoroalkyl citrate, M.W. of about 1,560 and fluorine content of about 63 percent); (6) sulfonic acid derivatives of perfluoroalkanes ($R_fCH_2CH_2$ $SO_3H$, wherein $R_f$= $F(CF_2CF_2)_n$), and n is as illustrated herein, such as ZONYL® TBS (M.W. of about 530 and fluorine content of about 62 percent); (7) ethoxysilane derivatives of fluoropolyethers such as FLUOROLINK® S10 (M.W. of about 1,750 to about 1,950); and (8) phosphate derivatives of fluoropolyethers such as FLUOROLINK® F10 (M.W. of about 2,400 to about 3,100). The FLUOROLINK® additives are available from Ausimont USA, and the ZONYL® additives are available from E.I. DuPont.

The overcoating layer further includes, in embodiments, a catalyst present in an amount of, for example, from about 0.5 to about 5 weight percent, or from about 1 to about 3 weight percent of the layer components. Crosslinking can be accomplished in embodiments by heating the overcoat components in the presence of an acid catalyst. Non-limiting examples of catalysts include oxalic acid, maleic acid, carbolic acid, ascorbic acid, malonic acid, succinic acid, tartaric acid, citric acid, p-toluenesulfonic acid (pTSA), methanesulfonic acid, dodecylbenzene sulfonic acid (DDBSA), dinonylnaphthalene disulfonic acid (DNNDSA), dinonylnaphthalene monosulfonic acid (DNNSA), and the like, and mixtures thereof.

A blocking agent can also be included in the overcoat layer, which agent can "tie up" or substantially block the acid catalyst effect to provide solution stability until the acid catalyst function is desired. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine, triethylamine, and the like as well as commercial acid solutions containing blocking agents such as CYCAT® 4045, available from Cytec Industries Inc.

While the percentage of crosslinking can be difficult to determine, and while not being desired to be limited by theory, the overcoat layer is crosslinked to a suitable value, such as for example, from about 50 to about 99 percent, from about 60 to about 95 percent, or from about 70 to about 90 percent.

PHOTOCONDUCTOR LAYER EXAMPLES

There can be selected for the photoconductors disclosed herein a number of known layers, such as substrates, photogenerating layers, charge transport layers, hole blocking layers, adhesive layers, protective overcoat layers, and the like. Examples, thicknesses, specific components of many of these layers include the following.

The thickness of the photoconductor substrate layer depends on many factors, including economical considerations, electrical characteristics, and the like, thus this layer may be of a substantial thickness, for example over 3,000 microns, such as from about 1,000 to about 2,000 microns, from about 500 to about 900 microns, from about 300 to about 700 microns, or of a minimum thickness. In embodiments, the thickness of this layer is from about 75 to about 300 microns, or from about 100 to about 150 microns.

The substrate may be opaque or substantially transparent, and may comprise any suitable material. Accordingly, the substrate may comprise a layer of an electrically nonconductive or conductive material, such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, as disclosed in a copending application referenced herein, this layer may be of a substantial thickness of, for example, up to many centimeters, or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer, in embodiments, is comprised of a number of known photogenerating pigments, such as for example, about 50 weight percent of Type V hydroxygallium phthalocyanine or chlorogallium phthalocyanine, and about 50 weight percent of a resin binder like poly(vinyl chloride-co-vinyl acetate) copolymer, such as VMCH (available from Dow Chemical). Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis (benzimidazo)perylene, titanyl phthalocyanines, and the like, and more specifically, vanadyl phthalocyanines, Type V hydroxygallium phthalocyanines, and inorganic components, such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer, in embodiments, is dependent primarily upon factors, such as photosensitivity, electrical properties, and mechanical considerations. The photogenerating layer binder resin is present in various suitable amounts, for example from about 1 to about 50 weight percent, and more specifically, from about 1 to about 10 weight percent, and which resin may be selected from a number of known polymers, such as poly(vinyl butyral), poly(vinyl carbazole), polyesters, polycarbonates, poly(vinyl chloride), polyacrylates, and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, silanols, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium, and alloys of selenium and arsenic, tellurium, germanium, and the like; hydrogenated amorphous silicon; and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments, such as quinacridones, polycyclic pigments, such as dibromo anthanthrone pigments, perylene and perinone diamines, polynuclear aromatic quinones, azo pigments including bis-, tris- and tetrakis-azos; and the like dispersed in a film forming polymeric binder, and fabricated by solvent coating techniques.

Infrared sensitivity can be achievable for photoreceptors exposed to low cost semiconductor laser diode light exposure devices where, for example, the absorption spectrum and photosensitivity of the pigments selected depend on the central metal atom thereof. Examples of such pigments include oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine, and metal free phthalocyanine. The phthalocyanines exist in many crystal forms, and have a strong influence on photogeneration.

In embodiments, examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylsilanols, polyarylsulfones, polybutadienes, polysulfones, polysilanolsulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

The photogenerating composition or pigment is present in the resinous binder composition in various amounts. Generally, however, from about 5 to about 90 percent by weight of the photogenerating pigment is dispersed in about 10 to about 95 percent by weight of the resinous binder, or from about 20 to about 50 percent by weight of the photogenerating pigment is dispersed in about 80 to about 50 percent by weight of the resinous binder composition. In one embodiment, about 50 percent by weight of the photogenerating pigment is dispersed in about 50 percent by weight of the resinous binder composition.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished as illustrated herein, and can be, for example, of a thickness of from about 0.01 to about 30 microns after being dried at, for example, about 40° C. to about 150° C. for about 15 to about 90 minutes. More specifically, a photogenerating layer of a thickness of, for example, from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer, and the photogenerating layer. Usually, the photogenerating layer is applied onto the blocking layer, and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and, in embodiments, is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layers for the imaging members of the present disclosure can contain a number of components including known hole blocking components, such as amino silanes, doped metal oxides, TiSi, a metal oxide like titanium, chromium, zinc, tin and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)

bisphenol), P (4,4'-(1,4-phenylene diisopropylidene) bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 to about 80 weight percent, and more specifically, from about 55 to about 65 weight percent of a suitable component like a metal oxide, such as $TiO_2$; from about 20 to about 70 weight percent, and more specifically, from about 25 to about 50 weight percent of a phenolic resin; from about 2 to about 20 weight percent, and more specifically, from about 5 to about 15 weight percent of a phenolic compound, more specifically, containing at least two phenolic groups, such as bisphenol S; and from about 2 to about 15 weight percent, and more specifically, from about 4 to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 to about 30 microns, and more specifically, from about 0.1 to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical); formaldehyde polymers with ammonia, cresol and phenol, such as VARCUM® 29112 (available from OxyChem Company); formaldehyde polymers with 4,4'-(1-methylethylidene)bisphenol, such as VARCUM® 29108 and 29116 (available from OxyChem Company); formaldehyde polymers with cresol and phenol, such as VARCUM® 29457 (available from OxyChem Company), DURITE® SD-423A, SD-422A (available from Borden Chemical); or formaldehyde polymers with phenol and p-tert-butylphenol, such as DURITE® ESD 556C (available from Borden Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

The charge transport layer, which layer is generally of a thickness of from about 5 to about 75 microns, and more specifically, of a thickness of from about 10 to about 40 microns, components, and molecules include a number of known materials, such as aryl amines, of the following formula

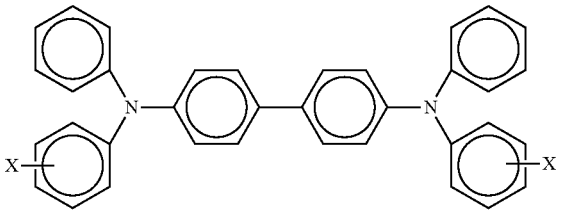

wherein X is alkyl, alkoxy, aryl, a halogen, or mixtures thereof, or wherein each X can also be present on each of the four terminating rings; and especially those substituents selected from the group consisting of $C_1$ and $CH_3$; and molecules of the following formula

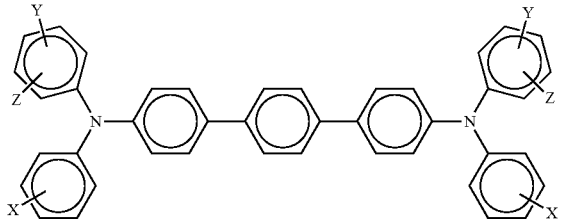

wherein at least one of X, Y and Z are independently alkyl, alkoxy, aryl, a halogen, or mixtures thereof, where Y can be present, Z may be present, or both Y and Z are present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]- 4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis (4-butylphenyl)-N,N'-bis-(2-ethyl-6-methylphenyl)-[p- terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

The charge transport layer component can also be selected as the charge transport compound for the photoconductor top overcoating layer.

Examples of the binder materials selected for the charge transport layers include a number of known components. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene) carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 to about 50 percent of this material.

The charge transport layer or layers, and more specifically, a first charge transport in contact with the photogenerating layer, and thereover a top or second charge transport layer may comprise charge transporting small molecules dissolved or molecularly dispersed in a film forming electrically inert polymer such as a polycarbonate. In embodiments, "dissolved" refers, for example, to forming a solution in which the small molecule and silanol are dissolved in the polymer to form a homogeneous phase; and "molecularly dispersed in embodiments" refers, for example, to charge transporting molecules dispersed in the polymer, and the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of charge transporting molecules present in the charge transport layer in an amount of, for example, from about 20 to about 55 weight percent include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butyl phenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles, such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or tri-amino-triphenyl methane. A small molecule charge transporting compound that permits injection of holes into the photogenerating layer with high efficiency, and transports them across the charge transport layer with short transit times, and which layer contains a binder and a charge transport component such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]- 4,4"-diamine, N,N'-bis(4-butylphenyl)-N,N'-bis-(4-isopropyl phenyl)-[p-terphenyl]-4,4"-diamine, N,N'-bis(4-butylphenyl)- N,N'-bis-(2-ethyl-6-methylphenyl)-[p-terphenyl]-4,4"-diamine, N,N'-bis(4-butylphenyl)-N,N'-bis-(2,5-dimethyl phenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers, in embodiments, is from about 5 to about 75 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported to selectively discharge a surface charge on the surface of the active layer.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from 0 to about 20, from about 1 to about 10, or from about 3 to about 8 weight percent.

Primarily for purposes of brevity, the examples of each of the substituents, and each of the components/compounds/molecules, polymers (components) for each of the layers specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. Similarly, the thickness of each of the layers, the examples of components in each of the layers, the amount ranges of each of the components disclosed and claimed are not exhaustive, and it is intended that the present disclosure and claims encompass other suitable parameters not disclosed or that may be envisioned.

The following Examples are provided.

EXAMPLE I

An overcoated photoconductor was prepared as follows. A three component hole blocking or undercoat layer was prepared as follows. Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The resulting solution was coated via a dip coater on a 30 millimeter aluminum tube, and the layer resulting was pre-heated at 59° C. for 13 minutes, humidified at 58° C. (dew point of 54° C.) for 17 minutes, and dried at 135° C. for 8 minutes. The thickness of the undercoat layer obtained was approximately 1.3 microns.

A photogenerating layer of a thickness of about 0.2 micron comprising hydroxygallium phthalocyanine Type V was deposited on the above hole blocking layer or undercoat layer with a thickness of about 1.3 microns. The photogenerating layer coating dispersion was prepared as follows. 3 Grams of hydroxygallium Type V pigment were mixed with 2 grams of a polymeric binder of a carboxyl-modified vinyl copolymer, VMCH, available from Dow Chemical Company, and 45 grams of n-butyl acetate. The resulting mixture was milled in an Attritor mill with about 200 grams of 1 millimeter Hi-Bea borosilicate glass beads for about 3 hours. The dispersion obtained was filtered through a 20 micron Nylon cloth filter, and the solid content of the dispersion was diluted to about 6 weight percent.

Subsequently, an 18 micron thick charge transport layer was coated on top of the photogenerating layer from a solution prepared from N,N'-diphenyl-N,N-bis(3-methylphenyl)-1,1'-biphenyl-4,4'-diamine (5 grams), a film forming polymer binder PCZ 400 [ poly(4,4'-dihydroxy-diphenyl-1-1-cyclohexane, $M_w$ of 40,000)] available from Mitsubishi Gas Chemical Company, Ltd. (7.5 grams) in a solvent mixture of 30 grams of tetrahydrofuran (THF), and 10 grams of monochlorobenzene (MCB) via simple mixing. The charge transport layer was dried at about 135° C. for about 40 minutes.

The overcoating layer solution was formed by adding 0.6 gram of 1,2-propanediolisobutyl POSS (a POSS alcohol obtained from Hybrid Plastics Inc., Hattiesburg, Miss.), 5.28 grams of CYMEL® 303 (a methylated, butylated melamine-formaldehyde obtained from Cytec Industries Inc.), 5.88 grams of N,N'-diphenyl-N,N'-bis(3-hydroxyphenyl)-[1,1'-biphenyl]-4,4'-diamine (DHTBD), 0.48 gram of BYK-SILCLEAN® 3700 (a hydroxylated silicone modified polyacrylate obtained from BYK-Chemie USA), and 0.6 gram of NACURE® XP357 (a blocked acid catalyst obtained from King Industries) in 28 grams of DOWANOL® PM (1-methoxy-2-propanol obtained from the Dow Chemical Company). The overcoating layer solution was applied on top of the charge transport layer, and upon drying at 155° C. for 40 minutes, a 7 micron thick overcoating layer was formed comprising 1,2-propanediolisobutyl POSS/CYMEL® 303/DHTBD/BYK-SILCLEAN® 3700/NACURE® XP357 at a ratio of May 44, 1949/1/1.

EXAMPLE II

An overcoated photoconductor was prepared by repeating the process of Example I except that a POSS epoxide was selected in place of the POSS alcohol. The POSS epoxide in the overcoating layer was epoxycyclohexylisobutyl POSS, obtained from Hybrid Plastics Inc., Hattiesburg, Miss. The resulting overcoating layer was about 7 microns thick, and comprised epoxycyclohexylisobutyl POSS/CYMEL® 303/DHTBD/BYK-SILCLEAN® 3700/NACURE® XP357 at a ratio of May 44, 1949/1/1.

EXAMPLE III

An overcoated photoconductor is prepared by repeating the process of Example I except that a POSS amine is selected in place of the POSS alcohol. The POSS amine in the overcoating layer is octaminophenyl POSS, obtainable from Hybrid Plastics Inc., Hattiesburg, Miss. The resulting overcoating layer is about 7 microns thick comprising octaminophenyl POSS/CYMEL® 303/DHTBD/BYK-SILCLEAN® 3700/NACURE® XP357 at a ratio of May 44, 1949/1/1.

EXAMPLE IV

An overcoated photoconductor is prepared by repeating the process of Example I except that a POSS carboxylic acid is selected in place of the POSS alcohol. The POSS carboxylic acid in the overcoating layer is octaamic acid POSS, obtainable from Hybrid Plastics Inc., Hattiesburg, Miss. The resulting overcoating layer is about 7 microns thick comprising octaamic acid POSS/CYMEL® 303/DHTBD/BYK-SILCLEAN® 3700/NACURE® XP357 at a ratio of May 44, 1949/1/1.

Electrical Property Testing

The above prepared two photoconductor devices (Example I and Example II) were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities are measured. Additional electrical characteristics were obtained by a series of charge-erase cycles with incrementing surface potential to generate several voltage versus charge density curves.

The scanner was equipped with a scorotron set to a constant voltage charging at various surface potentials. The devices were tested at surface potentials of −700V (volts) with the exposure light intensity incrementally increased with a data acquisition system where the current to the light emitting diode was controlled to obtain different exposure levels. The exposure light source was a 780 nanometer light emitting diode. The xerographic simulation was completed in an environmentally controlled light tight chamber at ambient conditions (45 percent relative humidity and 20° C.).

The Example I photoconductor exhibited a residual potential of about 155 V, while the Example II photoconductor exhibited a residual potential of about 134 V, thus both of the above overcoated photoconductors exhibited excellent PIDC characteristics.

Wear Testing

The wear test of the Example I photoconductor was performed using a FX469 (Fuji Xerox) wear fixture. The total thickness of the photoconductor was measured with a Permascope prior to the initiation of each wear test. Thereafter, the photoconductor was placed into the wear fixture for 50 kilocycles. The total thickness was measured again, and the difference in thickness was used to calculate wear rate (nanometers/kilocycle) of the photoconductor. The smaller the wear rate, the more wear resistant is the photoconductor. The wear rate of the Example I photoconductor was about 6.6 nanometers/kilocycle. Since the overcoat is about 7 microns thick, the projected life of the photoconductor was above 1 million cycles.

COMPARATIVE EXAMPLE 1

A photoconductor was prepared by repeating the process of Example I except that the overcoating layer of Example I was replaced with the following overcoating layer.

The overcoating layer solution was formed by adding 5.28 grams of CYMEL® 303 (a methylated, butylated melamine-formaldehyde crosslinking agent obtained from Cytec Industries Inc.), 6.48 grams of N,N'-diphenyl-N,N'-bis(3-hydroxyphenyl)-[1,1'-biphenyl]-4,4'-diamine (DHTBD), 0.48 gram of BYK-SILCLEAN® 3700 (a hydroxylated silicone modified polyacrylate obtained from BYK-Chemie USA), and 0.6 gram of NACURE® XP357 (a blocked acid catalyst obtained from King Industries) in 28 grams of DOWANOL® PM (1-methoxy-2-propanol obtained from the Dow Chemical Company). The overcoating layer solution was applied on top of the charge transport layer, and upon drying at 155° C. for 40 minutes, a 7 micron thick overcoating layer was formed comprised of CYMEL® 303/DHTBD/BYK-SILCLEAN® 3700/NACURE® XP357 at a ratio of 44/54/1/1.

The PIDC test for this Comparative Example evidenced that the $V_r$ was about 250V, compared with 155V for the Example I photoconductor and 134V for the Example II photoconductor. The photoconductor with a $V_r$ of about 250V was not as suitable as a photoconductor as compared to the Example I photoconductor that incorporated the POSS component into the overcoat, and which photoconductor reduced the $V_r$ by about 100V, thereby providing excellent xerographic developed images with minimal or no background deposits.

The wear rate of the Comparative Example 1 photoconductor was about 8 nanometers/kilocycle, or about 20 percent higher than that of the Example I photoconductor. Thus, the Example I photoconductor not only exhibited a100V lower $V_r$, but also a lower wear rate.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising an optional supporting substrate, a photogenerating layer, and a charge transport layer comprised of at least one charge transport component; and an overcoating in contact with and contiguous to said charge transport layer, and which overcoating is comprised of a crosslinked mixture of a charge transport component, a melamine polymer, and at least one of a polyhedral silsesquioxane (POSS) alcohol, and a polyhedral silsesquioxane (POSS) epoxide.

2. A photoconductor in accordance with claim 1 wherein said supporting substrate is present, and said overcoating layer further contains a catalyst, a crosslinkable siloxane, and a fluoro component.

3. A photoconductor in accordance with claim 1 wherein said overcoating mixture is reacted in the presence of an acid catalyst to form a crosslinked polymeric network.

4. A photoconductor in accordance with claim 1 wherein said crosslinking percentage is from about 50 to about 99 percent.

5. A photoconductor in accordance with claim 1 wherein said crosslinking percentage is from about 60 to about 95 percent, and wherein a crosslinked polymeric network is formed.

6. A photoconductor in accordance with claim 1 wherein said POSS alcohol is represented by

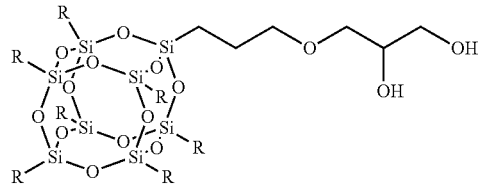

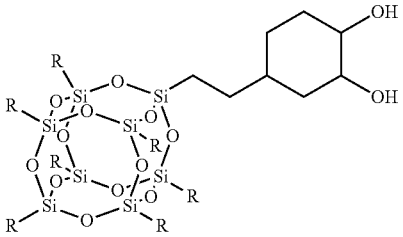

and

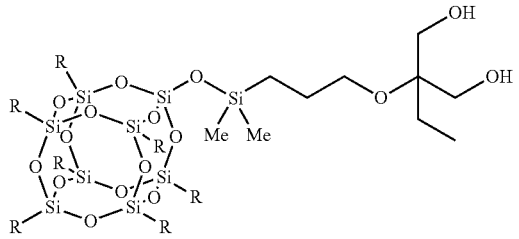

and comprises one POSS moiety and at least one alcohol group wherein each R substituent is alkyl, aryl, or mixtures thereof, and said POSS epoxide is represented by and comprises one POSS moiety and at least one epoxide group represented by

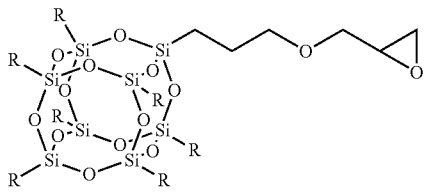

-continued

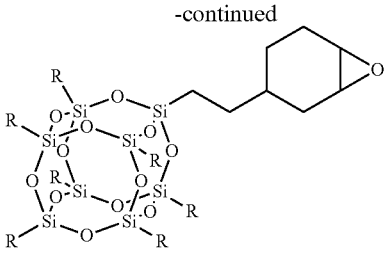

and

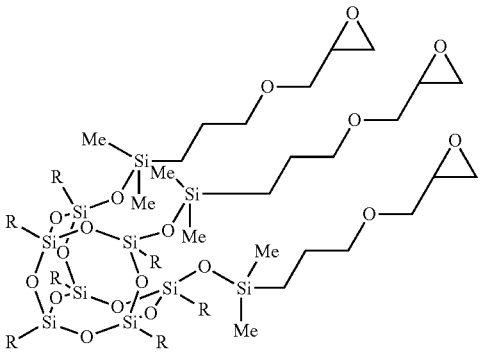

wherein each R is alkyl, aryl, or mixtures thereof, and Me is methyl.

7. A photoconductor in accordance with claim 1 wherein said POSS alcohol is one of TMP diolisobutyl POSS, trans-cyclohexanediolisobutyl POSS, 1,2-propanediolisobutyl POSS, or octa(3-hydroxy-3-methylbutyldimethylsiloxy) POSS; and said POSS epoxide is one of epoxycyclohexyl-isobutyl POSS, glycidylethyl POSS, glycidylisobutyl POSS, glycidylisooctyl POSS, triglycidylcyclohexyl POSS, triglycidylisobutyl POSS, glycidylphenyl POSS, octaepoxycyclohexyldimethylsilyl POSS, or octaglycidyldimethylsilyl POSS.

8. A photoconductor in accordance with claim 6 wherein R is methyl, ethyl, propyl, butyl, pentyl, hexyl, cyclohexyl, heptyl, octyl, or mixtures thereof.

9. A photoconductor in accordance with claim 1 wherein said overcoating charge transport component is

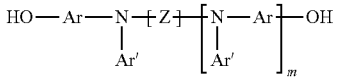

wherein m is zero or 1; Z is selected from the group consisting of at least one of

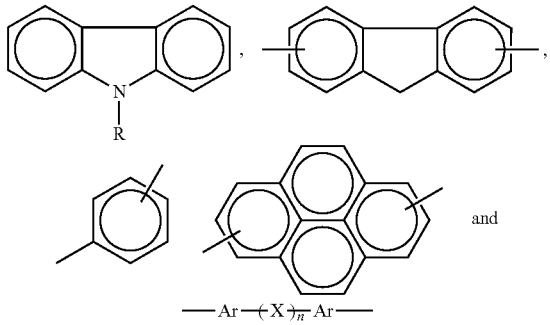

wherein n is 0 or 1; Ar is selected from the group consisting of at least one of

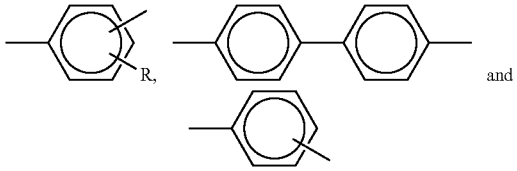

R is selected from the group consisting of at least one of —$CH_3$, —$C_2H_5$, —$C_3H_7$, and $C_4H_9$; and Ar' is selected from the group consisting of at least one of

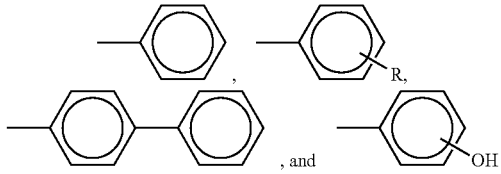

and X is selected from the group consisting of at least one of

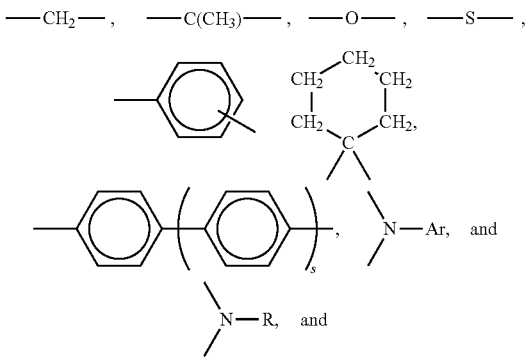

wherein S is zero, 1, or 2.

10. A photoconductor in accordance with claim 1 wherein the melamine polymer is represented by

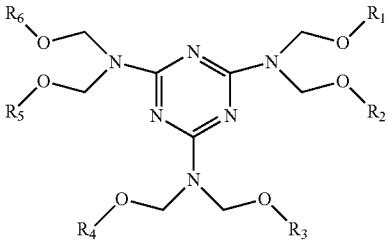

wherein each of $R_1$, $R_2$, $R_3$, $R_4$, $R_5$ and $R_6$ independently represents a hydrogen atom, alkyl, aryl, or mixtures thereof.

11. A photoconductor in accordance with claim 10 wherein said alkyl contains from 1 to about 12 carbon atoms, and said aryl contains from 6 to about 18 carbon atoms.

12. A photoconductor in accordance with claim 10 wherein said melamine polymer is selected from the group consisting of methylated formaldehyde-melamine resin, methoxymethylated melamine resin, ethoxymethylated melamine resin, propoxymethylated melamine resin, butoxymethylated melamine resin, hexamethylol melamine resin, and mixtures thereof.

13. A photoconductor in accordance with claim 1 wherein said overcoating charge transport component is at least one of N,N'-diphenyl-N,N'-bis(3-hydroxyphenyl)-[1,1'-biphenyl]-4,4'-diamine (DHTPD) represented by

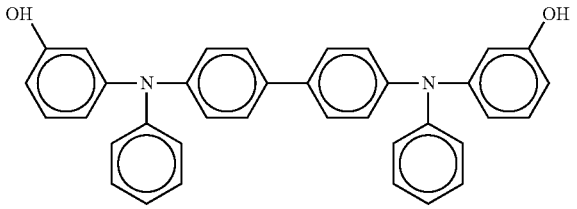

or dihydroxyaryl terphenylamines as represented by

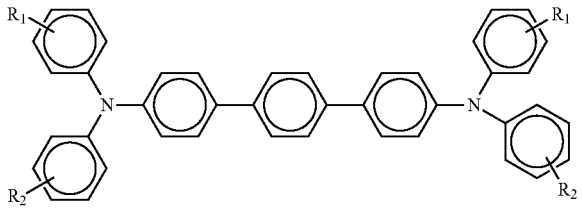

wherein each $R_1$ and $R_2$ is independently selected from the group consisting of at least one of —H, —OH, —$C_nH_{2n+1}$ where n is from 1 to about 12; aralkyl and aryl groups, each containing from about 6 to about 36 carbon atoms.

14. A photoconductor in accordance with claim 1 wherein said charge transport component for said charge transport layer is comprised of aryl amines represented by

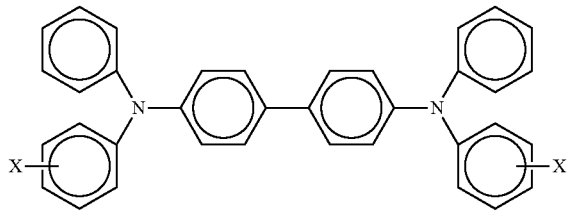

or

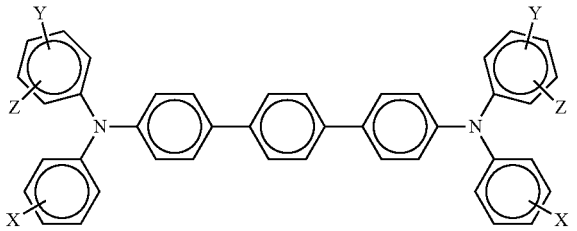

wherein X, Y and Z are selected from the group comprised of at least one of alkyl, alkoxy, aryl, and halogen.

15. A photoconductor in accordance with claim 14 wherein said alkyl and said alkoxy each contains from about 1 to about 12 carbon atoms, and said aryl contains from about 6 to about 36 carbon atoms.

16. A photoconductor in accordance with claim 14 wherein said aryl amine is selected from the group consisting of N,N'-diphenyl-N,N-bis(3-methylphenyl)-1,1'-biphenyl-4,4'-diamine, N,N-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N-bis(4-butylphenyl)-N,N'-di-o-tolyl-[p-terphenyl]-4,4"-diamine, N,N'-bis(4-butyl phenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and mixtures thereof.

17. A photoconductor in accordance with claim 1 further including in said charge transport layer an antioxidant comprised of a hindered phenolic or a hindered amine.

18. A photoconductor in accordance with claim 1 wherein said photogenerating layer is comprised of photogenerating component comprised of a photogenerating pigment or photogenerating pigments.

19. A photoconductor in accordance with claim 18 wherein said photogenerating pigment is comprised of at least one of a metal phthalocyanine, a metal free phthalocyanine, a titanyl phthalocyanine, a halogallium phthalocyanine, a perylene, or mixtures thereof.

20. A photoconductor in accordance with claim 1 further including a hole blocking layer, and an adhesive layer.

21. A photoconductor in accordance with claim 1 wherein said charge transport layer contains from 1 to about 3 layers.

22. A photoconductor in accordance with claim 1 wherein said charge transport layer is comprised of a top charge transport layer and a bottom charge transport layer, and wherein said top layer is in contact with said bottom layer, and said bottom layer is in contact with said photogenerating layer.

23. A photoconductor in accordance with claim 1 wherein said melamine polymer is present in an amount of from about 1 to about 70 weight percent, said overcoating charge transport component is present in an amount of from about 20 to about 90 weight percent, and said POSS component is present in an amount of from about 1 to about 30 weight percent based on the total overcoating layer components amount.

24. A photoconductor in accordance with claim 1 wherein said melamine polymer is present in an amount of from about 10 to about 50 weight percent; said overcoating charge transport component is present in an amount of from about 30 to about 60 weight percent; and said POSS component is present in an amount of from about 5 to about 15 weight percent.

25. A photoconductor in accordance with claim 1 wherein said melamine polymer is present in an amount of from about 1 to about 70 weight percent; said overcoating charge transport component is present in an amount of from about 20 to about 90 weight percent; and said POSS component is present in an amount of from about 1 to about 30 weight percent of said overcoating layer components.

26. A photoconductor in accordance with claim 1 wherein said melamine polymer is present in an amount of from about 10 to about 50 weight percent; said overcoating charge transport component is present in an amount of from about 30 to about 60 weight percent; and said POSS component is present in an amount of from about 5 to about 15 weight percent of said overcoating layer.

27. A photoconductor comprised in sequence of a supporting substrate, a photogenerating layer comprised of at least one photogenerating pigment, thereover a charge transport layer comprised of at least one charge transport component and an overcoating layer in contact with the top surface of said charge transport layer, and which overcoating layer is comprised of a mixture of an overcoating charge transport component, a melamine polymer and at least one of a POSS component of a POSS alcohol, a POSS epoxide, a POSS amine, and a POSS carboxylic acid, and wherein said mixture is crosslinked in the presence of a catalyst; and wherein said charge transport component for said charge transport layer is represented by

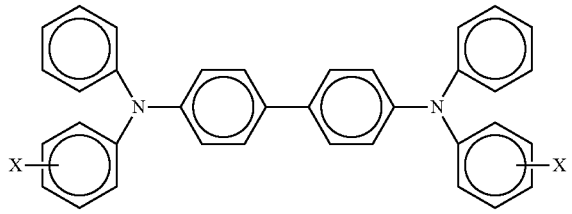

or

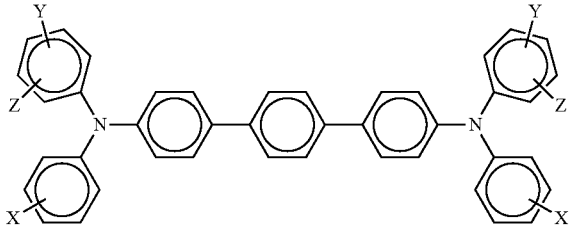

wherein each x, y and z are alkyl, alkoxy, halogen or aryl, and said charge transport component for said overcoating layer is represented by

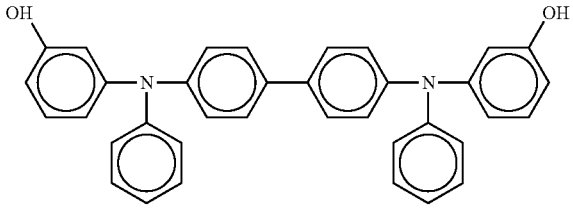

or

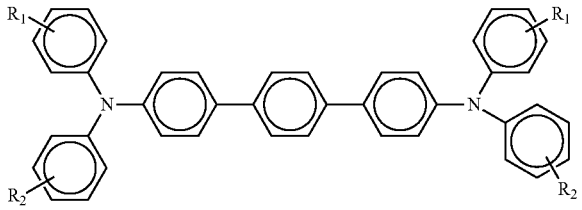

wherein each $R_1$ and $R_2$ is independently selected from the group consisting of at least one of —H, —OH, —$C_nH_{2n+1}$ where n is from 1 to about 12; aralkyl or aryl, and wherein said melamine polymer is represented by

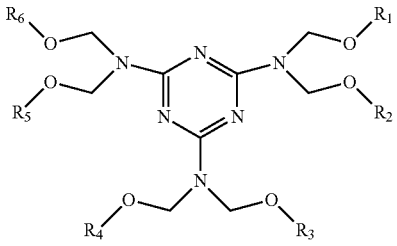

wherein $R_1$, $R_2$, $R_3$, $R_4$, $R_5$ and $R_6$ independently represent a hydrogen atom, alkyl, aryl, or mixtures thereof, and said overcoating layer further contains a catalyst, a crosslinkable siloxane and a fluoro component; and wherein said POSS component is represented by

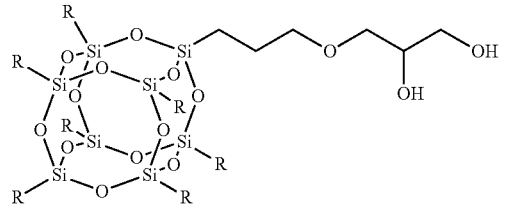

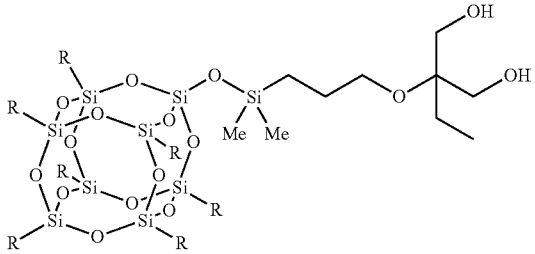

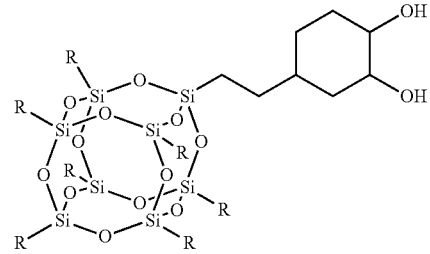

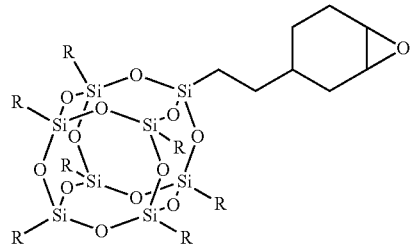

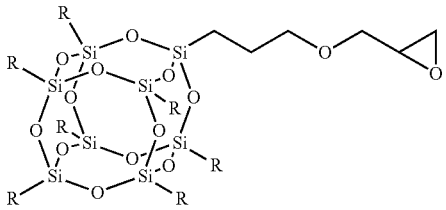

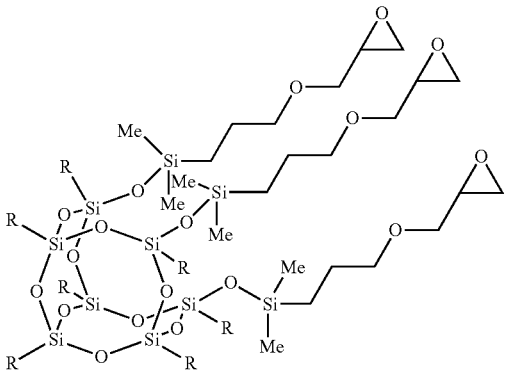

-continued

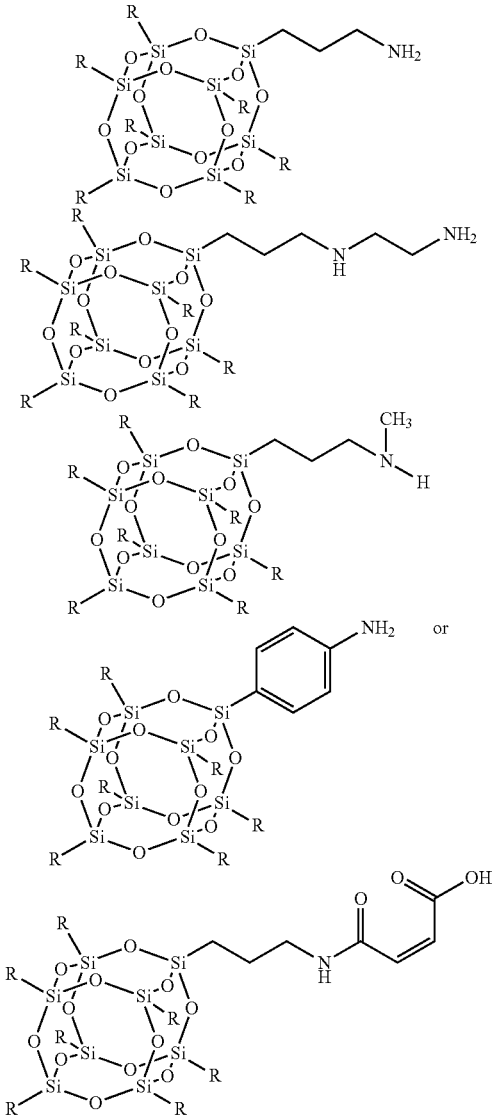

wherein each R substituent is alkyl or aryl.

28. A photoconductor in accordance with claim 27 wherein said charge transport component for said charge transport layer is N,N'-diphenyl-N,N'-bis(3-methylphenyl)-(1,1'-biphenyl)-4,4'-diamine, or N,N'-bis(4-butylphenyl)-N,N'-di-p-tolyl-[p-terphenyl]-4,4"-diamine; said charge transport component for said overcoating layer is N,N'-diphenyl-N,N'-bis(3-hydroxyphenyl)-[1,1'-biphenyl]-4,4'-diamine; said POSS is 1,2-propanediolisobutyl POSS, or glycidylisobutyl POSS; said melamine polymer is methoxymethylated melamine resin, or butoxymethylated melamine resin; said catalyst is p-toluenesulfonic acid or methanesulfonic acid; said siloxane component is a hydroxyl derivative of a silicone modified polyacrylate, or a polyether modified hydroxyl polydimethylsiloxane; and said fluoro component is a hydroxyl derivative of perfluoropolyoxyalkane, or a hydroxyl derivative of perfluoroalkane.

29. A photoconductor in accordance with claim 27 wherein said melamine polymer is present in an amount of from about 1 to about 70 weight percent; said overcoating charge transport component is present in an amount of from about 20 to about 90 weight percent; said POSS component is present in an amount of from about 1 to about 30 weight percent; said catalyst is present in an amount of from about 0.5 to about 5 weight percent; and said siloxane or fluoro component is present in an amount of from about 0.5 to about 10 weight percent based the overcoating layer components of about 100 percent.

30. A photoconductor in accordance with claim 27 wherein said melamine polymer is present in an amount of from about 10 to about 50 weight percent; said overcoating charge transport component is present in an amount of from about 30 to about 60 weight percent; said POSS component is present in an amount of from about 5 to about 15 weight percent; said catalyst is present in an amount of from about 1 to about 3 weight percent; and said siloxane or fluoro component is present in an amount of from about 1 to about 5 weight percent, and the total thereof of said components in said overcoating layer is about 100 percent.

31. A photoconductor comprised in sequence of a supporting substrate, a photogenerating layer comprised of at least one photogenerating pigment, thereover at least one charge transport layer comprised of at least one charge transport component and an overcoating layer in contact with the top surface of said charge transport layer, and which overcoating layer is comprised of a crosslinked mixture of an overcoating charge transport component, a melamine polymer, and a POSS alcohol, a POSS epoxide, a POSS amine or a POSS carboxylic acid, and wherein said mixture is crosslinked in the presence of a catalyst; and wherein said melamine polymer is present in an amount of from about 1 to about 70 weight percent; said overcoating charge transport component is present in an amount of from about 20 to about 90 weight percent; and said POSS component is present in an amount of from about 1 to about 30 weight percent of said overcoating layer components, and said POSS is a polyhedral silsesquioxane.

32. A photoconductor in accordance with claim 31 wherein said overcoating further includes a siloxane component of a hydroxyl derivative of a silicone modified polyacrylate, a polyether modified acryl polydimethylsiloxane, or a polyether modified hydroxyl polydimethylsiloxane; a fluoro component at least one of hydroxyl derivatives of perfluoropolyoxyalkanes; and hydroxyl derivatives of perfluoroalkanes; carboxylic acid derivatives of fluoropolyethers, carboxylic ester derivatives of fluoropolyethers, carboxylic ester derivatives of perfluoroalkanes; sulfonic acid derivatives of perfluoroalkanes; silane derivatives of fluoropolyethers; or phosphate derivatives of fluoropolyethers.

33. A photoconductor in accordance with claim 31 wherein said polyhedral silsesquioxane (POSS) amine is represented by

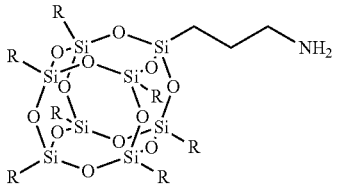

-continued

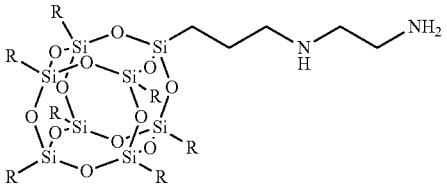

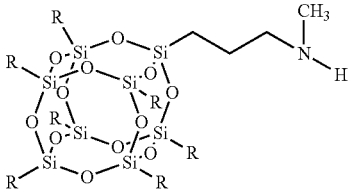

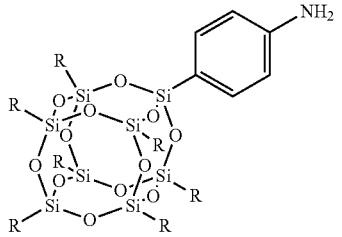

and said POSS carboxylic acid comprises one POSS moiety, and at least one carboxylic acid group, and is represented by

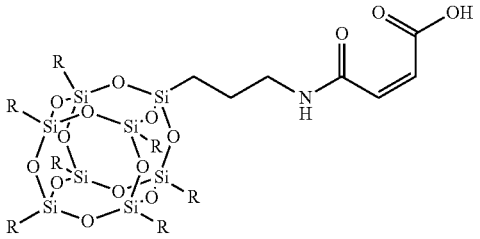

wherein each R is an alkyl with from about 1 to about 18 carbon atoms, or an aryl with from about 6 to about 24 carbon atoms, and said silsesquioxane is a polyhedral oligomeric silsesquioxane.

34. A photoconductor in accordance with claim 31 wherein said POSS amine is one of aminopropylisobutyl POSS, aminopropylisooctyl POSS, aminopropylphenyl POSS, aminoethylaminopropylisobutyl POSS, octaminophenyl POSS, N-phenylaminopropyl POSS, N-methylaminopropylisobutyl POSS, octaammonium POSS, p-aminophenylcyclohexyl POSS, m-aminophenylcyclohexyl POSS, p-aminophenylisobutyl POSS, or m-aminophenylisobutyl POSS; and said POSS carboxylic acid is amic acid-cyclohexyl POSS, amic acid-isobutyl POSS, amic acid-phenyl POSS, or octaamic acid POSS.

* * * * *